US005748433A

United States Patent [19]

Schrey et al.

[11] Patent Number: 5,748,433

[45] Date of Patent: May 5, 1998

[54] METHOD OF ACCURATELY CONTROLLING THE ARMATURE MOTION OF AN ELECTROMAGNETIC ACTUATOR

[75] Inventors: Ekkehard Schrey, Aachen; Lutz Kather, Würselen; Frank Van Der Staay, Aachen, all of Germany

[73] Assignee: FEV Motorentechnik GmbH & Co. KG, Aachen, Germany

[21] Appl. No.: 683,970

[22] Filed: Jul. 22, 1996

[30] Foreign Application Priority Data

Jul. 21, 1995 [DE] Germany ..... 195 26 681.1

[51] Int. Cl.[6] ..... F01L 9/02

[52] U.S. Cl. ..... 361/210; 123/90.11; 361/160; 361/195; 335/256; 335/266

[58] Field of Search ..... 123/90.11; 251/129.09, 251/129.1, 129.15, 129.16; 361/160, 210, 166, 167, 195; 335/229–234, 255, 256, 266

[56] References Cited

U.S. PATENT DOCUMENTS 5,339,777 8/1994 Cannon ..... 123/90.12

FOREIGN PATENT DOCUMENTS 0 264 706 4/1988 European Pat. Off. .

0 405 189 9/1993 European Pat. Off. .

30 24 109 9/1989 Germany .

*Primary Examiner*—Michael L. Gellner

*Assistant Examiner*—Raymond Barrera

*Attorney, Agent, or Firm*—Spencer & Frank

[57] ABSTRACT

A method of controlling a motion of an armature away from an electromagnet of an electromagnetic actuator includes the following steps: passing an electric current through a solenoid of the electromagnet for holding the armature at the electromagnet against a resetting force; interrupting the current flow through the solenoid at a desired moment for releasing the armature from the electromagnet; and impressing a current pulse of reverse polarity on the solenoid after interrupting the current flow for launching the armature from the electromagnet.

1 Claim, 3 Drawing Sheets

METHOD OF ACCURATELY CONTROLLING THE ARMATURE MOTION OF AN ELECTROMAGNETIC ACTUATOR

CROSS REFERENCE TO RELATED APPLICATION

This application claims the priority of German Application No. 195 26 681.1 filed Jul. 21, 1995, which is incorporated herewith by reference.

BACKGROUND OF THE INVENTION

Electromagnetic actuators such as used, for example, for operating engine cylinder valves in internal combustion engines, have at least one electromagnet by means of which an electromagnetic force is exerted on an armature which is held by return means and which is coupled with the cylinder valve. By the electromagnet (holding magnet) the armature is held in the one operational position and by deenergizing the holding magnet the armature is moved toward and/or into the other operational position by the return means such as a return spring. In actuators which are used for operating cylinder valves, the course of the control has a substantial effect on various parameters such as the conditions of the gas mixture in the intake zone, the conditions in the combustion chamber and in the exhaust zone as well as the operational sequences in the combustion chamber itself. Since piston-type internal combustion engines operate in a non-stationary manner under widely varying operational conditions, a correspondingly variable and adaptable control of the cylinder valves is required. Such an electromagnetic actuator for operating cylinder valves is disclosed, for example, in German Patent No. 3,024,109.

A significant problem in the control of electromagnetic actuators of the above-outlined type involves the required accuracy in timing which is particularly important for actuating the intake valves for controlling the engine output. A precise control of the times is rendered more difficult by manufacturing tolerances, the wear of components as well as various operational conditions such as the alternating load requirements and working frequencies because these external effects may influence time-relevant parameters of the system.

In electromagnetic actuators of the above-outlined type the sticking of the armature to the holding magnet poses a significant difficulty. This phenomenon is caused essentially by eddy currents in the magnetic circuit. The sticking period depends from a number of different parameters, such as, for example, the size of the air gap, the force of the return means (usually mechanical springs), accelerations affecting the actuator and the counterpressure of gases in case the electromagnetic actuator is associated with an engine-cylinder valve. In addition to the unavoidable manufacturing tolerances in electromagnetically actuated cylinder valves, the alternating gas counterpressures as well as acceleration forces which act on the armature and whose magnitude is unpredictable, result in irregular fluctuations of the sticking period so that after deenergization of the holding magnet, the beginning of the motion of the armature varies in a manner which cannot be determined in advance. The duration of armature motion too, as well as the energy losses and thus the energy to be supplied for capturing the armature depend from the momentary operational conditions.

If the exact armature position as a function of time is known, an at least partial compensation for the discussed effects could be made. This would require, however, an additional path sensor for the detection of the exact armature position. Such an arrangement, however, cannot be provided in mass production because of the high cost involved and because of the need for additional leads and contacts which reduce the reliability of the system.

For the above-discussed reasons it has been attempted to resolve the problem only with the already present structural elements of the electromagnetic actuator. Thus, in published European Patent Application 0 264 706 measures are disclosed how the moment of impacting by the armature may be determined by evaluating voltages and currents in the solenoid of the electromagnets. In a similar manner, it is also feasible to detect the moment of separation of the armature from the holding magnet. The motion velocities of the armature between the two electromagnets of such an electromagnetic actuator, however, are very small in the zone of the end position so that while in case of a relatively good resolution the position of the armature may be determined with sufficient accuracy, a corresponding timewise resolution with the required accuracy is not feasible. Further, for improving electromagnetic actuators of the above-outlined type, published European Application No. 0 405 189 proposes to improve the time accuracy by increasing the bias of the return spring acting in the opening direction. For this purpose additional measures are provided to vary the magnetic resistance in the magnetic circuit.

SUMMARY OF THE INVENTION

Since, however, neither the mechanical means as disclosed in published European Application 0 405 189 nor the computer-based means disclosed in published European Application 0 264 706 satisfy the accuracy requirements, it is an object of the invention to provide a method which improves the accuracy of determining the moment of release of the armature from the holding electromagnet.

This object and others to become apparent as the specification progresses, are accomplished by the invention, according to which, briefly stated, the method of controlling a motion of an armature away from an electromagnet of an electromagnetic actuator includes the following steps: passing an electric current through a solenoid of the electromagnet for holding the armature at the electromagnet against a resetting force; interrupting the current flow through the solenoid at a desired moment for releasing the armature from the electromagnet; and impressing a current pulse of reverse polarity on the solenoid after interrupting the current flow for launching the armature from the electromagnet.

In the method according to the invention as outlined above, the moment when armature motion starts can be determined with greater accuracy by virtue of an intentional "launching" of the armature from the pole face of the holding magnet. By applying a current pulse with a reversed polarity, a defined moment for the starting motion is obtained without appreciable fluctuations of the sticking period so that in the control process a reduced and, in particular, a constant sticking period may be relied upon. As opposed to known processes in which the constant for the sticking period was to be achieved by increasing the spring forces or by increasing the size of an air gap, the inventive process represents a significant improvement because the disadvantages of the known processes, together with their higher energy requirement, may be avoided. After the interruption of the current flowing through the solenoid of the holding magnet, the magnetic force decays exponentially because, based on the eddy currents, the resulting magnetic field also decays exponentially. By impressing a counter-current according to the invention, the duration of the decay of the magnetic field can be reduced.

According to a further feature of the method of the invention, the solenoid of the holding magnet is maintained in a deenergized state during a time period $T_0$. While in principle it is possible to set the time period $T_0$ between the moment of deenergizing the holding current and the impression of the current pulse with opposite polarity to zero (since the impression of the countercurrent immediately after deenergization leads to a reduction of the sticking period due to the more rapid force build-up), such an arrangement would improve the desired sticking time constant only to a slight extent as compared to conventional methods. Parallel to the exponential decay of the holding force of the magnet after interrupting the holding current, an approximately exponential decay of the counterforce effected by the inner cylinder pressure is obtained so that in conjunction with the mechanical accelerations affecting the armature, a non-definable moment for the force equilibrium and thus significantly fluctuating time periods are obtained for the system. If, however, according to the feature according to the invention, the countercurrent is impressed only after a certain time period $T_0$ following the deenergization of the holding magnet, a force leap is obtained at the armature at the moment of applying the countercurrent and thus a timewise definable start of armature motion results.

DESCRIPTION OF THE PREFERRED EMBODIMENT

Figure 1:
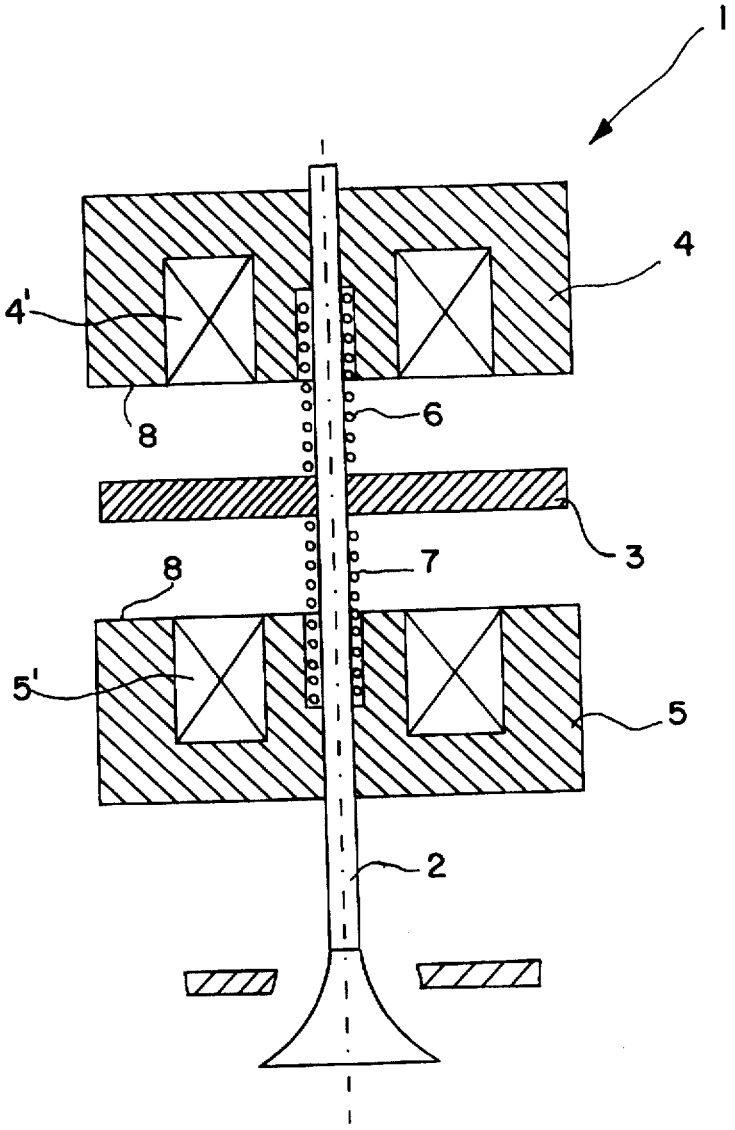
FIG. 1 is a schematic sectional side elevational view of an electromagnetic actuator for a cylinder valve for practicing the method according to the invention.

FIG. 1 schematically illustrates an electromagnetic actuator generally designated at 1, having an armature 3 which is attached to the stem of a cylinder valve 2 as well as a closing magnet 4 and an opening magnet 5 acting on the armature 3. The closing magnet 4 has a solenoid 4' and the opening magnet 5 has a solenoid 5'. Both magnets 4 and 5 have corresponding pole faces 8. In the deenergized state of the magnets 4 and 5 the armature 3 is maintained in a position of rest between the two magnets 4 and 5 by oppositely working return springs 6 and 7.

In the "valve closed" position the armature 3 engages the pole face 8 of the closing magnet 4.

For operating the cylinder valve 2, that is, for initiating a motion from the closed position into the open position, the flow of the holding current through the solenoid 4' of the closing magnet 4 is discontinued. As a result, the holding force of the closing magnet 4 falls below the spring force of the return spring 6 and thus the armature begins its motion, accelerated by the return spring 6. After the armature 3 has traversed the position of rest, its motion is braked by the spring force of the return spring 7 associated with the opening magnet 5. To catch the armature 3 in the open position and to retain it there, the opening magnet 5 is supplied with current. For closing the cylinder valve 2, the above-described switching and motion sequence is effected in the reverse sense.

Figure 2:
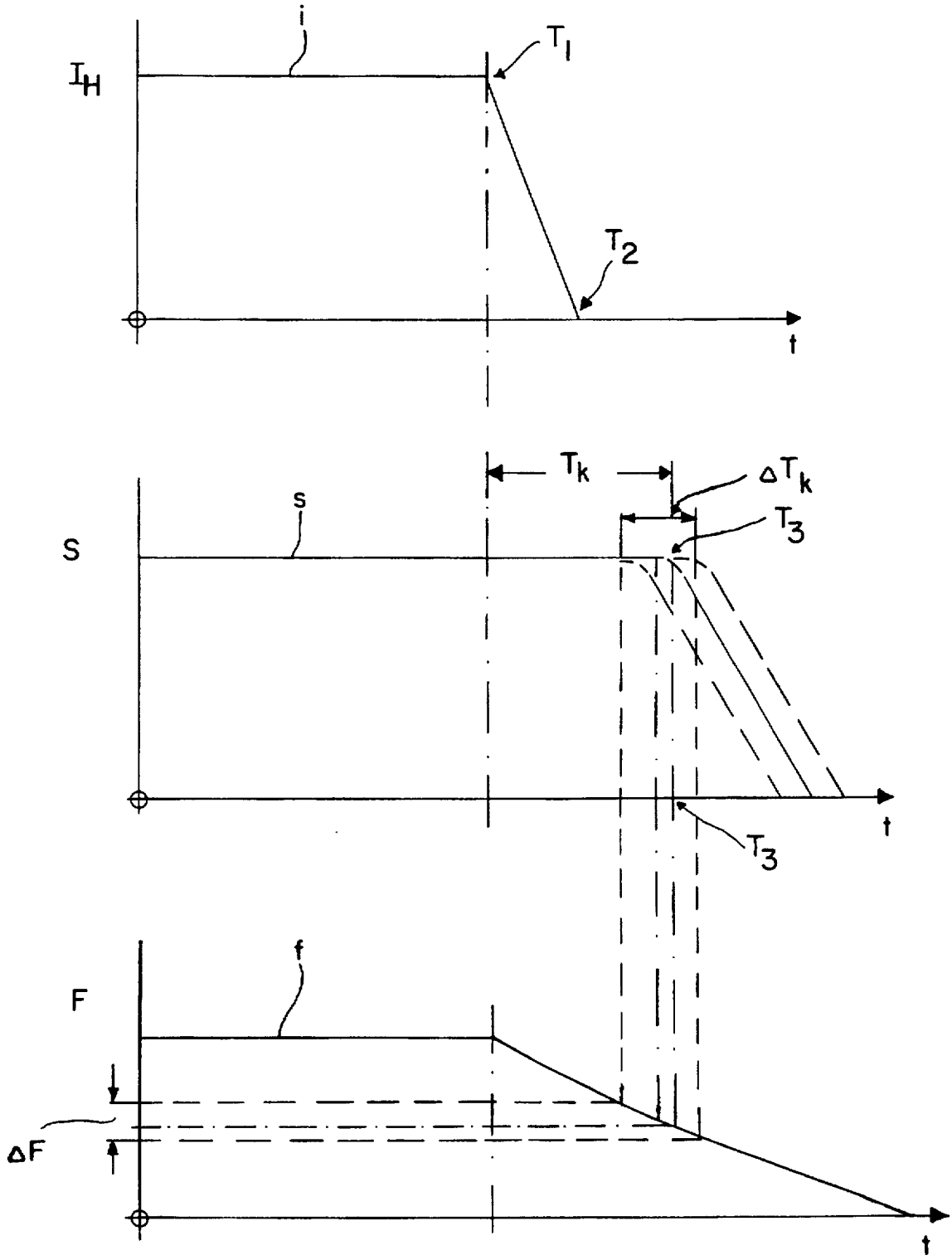
FIG.2 (PRIOR ART)
FIG. 2 is a diagram illustrating the holding current, the armature motion and the magnetic force as a function of time in a control according to the prior art.

Turning to FIG. 2, if in a conventionally controlled electromagnetic actuator for an engine-cylinder valve the holding current $I_H$ is discontinued at moment $T_1$, at a short period of time thereafter, the current attains the zero value at moment $T_2$, as shown by the current curve i. It would be desirable if the motion of the armature would start at the moment $T_2$. As shown by the armature displacement curve s, because of the earlier-described numerous effects (such as eddy currents), a sticking period $T_k$ is present which leads to a delayed start of the armature motion. In an ideal system a constant sticking period $T_k$ may be theoretically assumed so that after interrupting the holding current $I_H$ at the moment $T_1$, the armature would separate from the holding magnet after a lapse of the time period $T_k$. Such an additional time $T_k$ may be taken into consideration in the control start of the system so that theoretically a time-accurate motion start of the armature could be determined.

As it has been explained before, however, the start of armature motion is influenced by many effects so that the actual moment of the armature start oscillates by a period $\Delta T_k$ about the theoretically determined moment $T_3=T_1+T_k$ as shown for the path curve s.

The oscillation amplitude $\Delta T_k$ is caused by alternating counterforces $\Delta F$ as shown for the magnetic force curve f in FIG. 2. At higher spring forces and smaller gas counterpressures, the actual start of the armature motion shifts to a moment prior to the moment $T_3$, while the actual moment of armature start is shifted after the moment $T_3$ in case of higher gas counterpressures at the same spring force.

Figure 3:
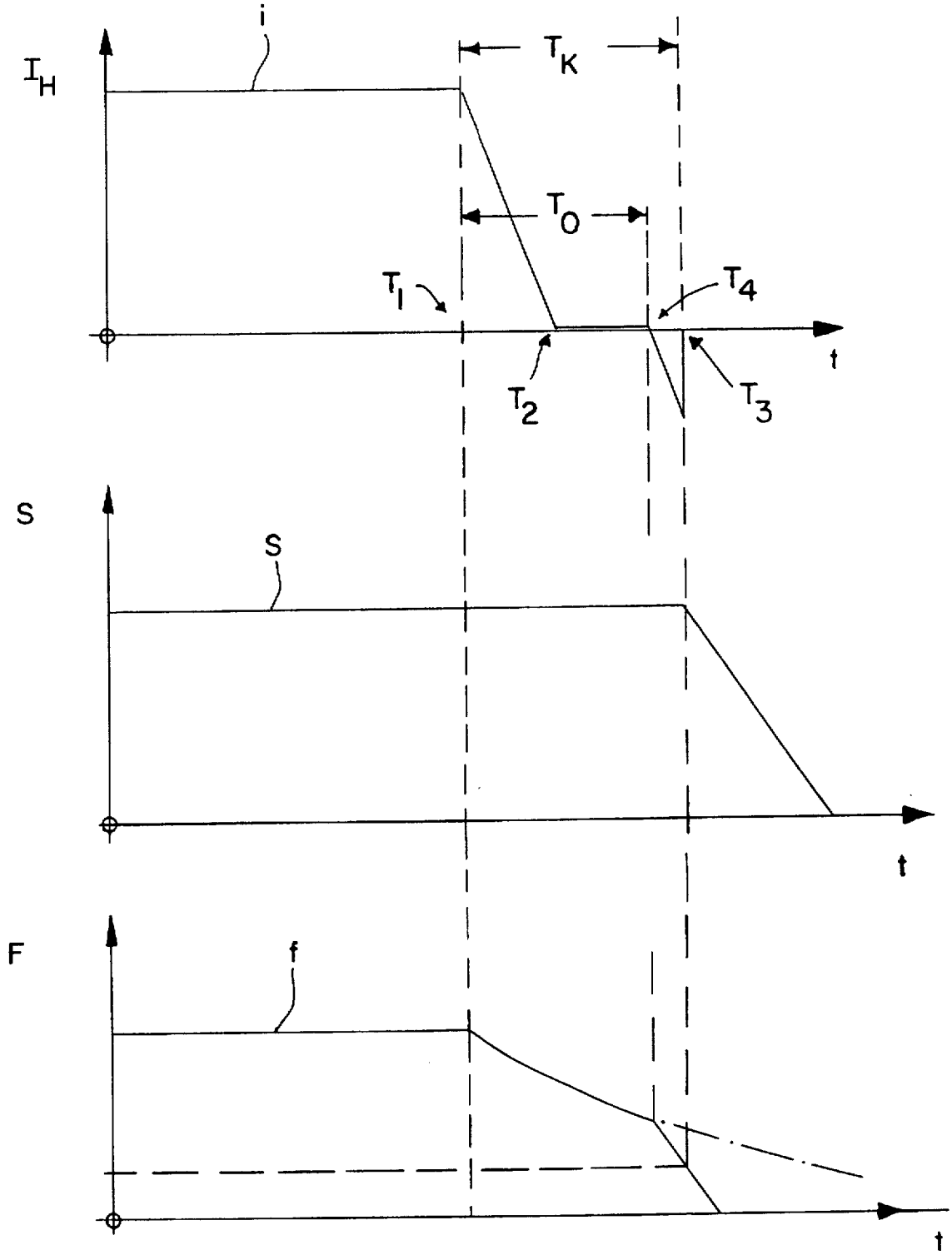
FIG. 3 is a diagram illustrating the holding current, the armature motion and the magnetic force as a function of time in a control according to the invention.

Turning now to FIG. 3, if after interrupting the holding current $I_H$ at the moment $T_1$ the solenoid of the holding magnet is maintained deenergized throughout a given period $T_0$ until moment $T_4$, wherein the period $T_0$ is less than the sticking period $T_k$ determined by the system and if at the moment $T_4$ a short current pulse with reversed polarity is impressed on the solenoid, the armature starts its motion at a definable moment, namely, at the moment $T_3=T_1+T_k$ as shown by the armature displacement curve s in FIG. 3.

As seen from the magnetic force curve f in FIG. 3, as a result of the counterpulse, the magnetic force at the holding magnet drops significantly steeper and thus the forces of the return means affecting the armature take full effect much sooner. By appropriately setting the period $T_0$, it is thus feasible to predetermine a sticking period having a negligible fluctuation width so that with the aid of the electronic control the exact moment of "launching" the armature from the holding magnet may be accurately predetermined as a function of the position of the crankshaft in an internal combustion engine.

It will be understood that the above description of the present invention is susceptible to various modifications, changes and adaptations, and the same are intended to be comprehended within the meaning and range of equivalents of the appended claims.

What is claimed is:

1. A method of electromagnetically controlling a motion of an engine cylinder valve, including the steps of (a) providing an armature;

(b) directly attaching the armature to the engine cylinder valve;

(c) providing a resetting spring arrangement to act on the armature;

(d) providing two electromagnets between which the armature is movable against a resetting force of the resetting spring arrangement;

(e) passing an electric current through the solenoid of one of the electromagnets for holding the armature, during current flow, at said one electromagnet against the resetting force;

(f) interrupting the current flow through the solenoid of said one electromagnet at a desired moment for releasing the armature from said one electromagnet;

(g) at the end of a predetermined period which runs from said desired moment and during which the solenoid of said one electromagnet is currentless, impressing a current pulse of reverse polarity on the solenoid of said one electromagnet for launching the armature from said one electromagnet; and (h) transferring forces applied by the resetting spring arrangement and the electromagnets to the armature directly to the engine valve from the armature.

* * * * *